US006829817B2

(12) United States Patent
Ngo et al.

(10) Patent No.: US 6,829,817 B2
(45) Date of Patent: Dec. 14, 2004

(54) APPARATUS AND METHOD FOR THE MANUFACTURE OF LARGE TRANSFORMERS HAVING LAMINATED CORES, PARTICULARLY CORES OF ANNEALED AMORPHOUS METAL ALLOYS

(76) Inventors: Dung A. Ngo, 130 Littleton Rd., Morris Plains, NJ (US) 07950; Kimberly M. Borgmeier, 195 College Farm Rd., Waltham, MA (US) 02451

( * ) Notice: Subject to any disclaimer, the term of this patent is extended or adjusted under 35 U.S.C. 154(b) by 202 days.

(21) Appl. No.: 10/349,878

(22) Filed: Jan. 23, 2003

(65) Prior Publication Data

US 2003/0128094 A1 Jul. 10, 2003

Related U.S. Application Data

(62) Division of application No. 09/841,833, filed on Apr. 25, 2001.

(51) Int. Cl.[7] ..... H01F 27/24; H01F 7/06

(52) U.S. Cl. ..... 29/602.1; 29/606; 336/212; 336/170; 336/234; 336/185

(58) Field of Search ..... 29/602.1, 606; 336/212, 234, 170, 185

(56) References Cited

U.S. PATENT DOCUMENTS

| | | | | | |
|---|---|---|---|---|---|
| 3,881,244 | A | * | 5/1975 | Kendall | 29/602.1 |
| 4,438,421 | A | * | 3/1984 | Leach, Jr. | 336/65 |
| 4,599,594 | A | * | 7/1986 | Siman | 336/92 |
| 4,766,407 | A | * | 8/1988 | Grimes | 336/196 |
| 5,062,197 | A | * | 11/1991 | Ngo et al. | 29/606 |
| 5,319,341 | A | * | 6/1994 | Bisbee et al. | 336/67 |
| 5,608,371 | A | * | 3/1997 | Valencic et al. | 336/210 |
| 5,949,030 | A | * | 9/1999 | Fasano et al. | 174/262 |

* cited by examiner

*Primary Examiner*—Anh Mai
(74) *Attorney, Agent, or Firm*—Ernest D. Buff and Associates, LLC; Ernest D. Buff; Gordon E. Fish

(57) ABSTRACT

The invention provides an apparatus and manufacturing methods useful in the manufacture of large transformer cores, particularly, in the manufacture of large transformer cores made of a ferromagnetic material, especially of annealed amorphous metal alloys. The invention further provides transformer cores produced utilizing the inventive apparatus and manufacturing methods, as well as finished transformers which include such transformer cores.

8 Claims, 7 Drawing Sheets

APPARATUS AND METHOD FOR THE MANUFACTURE OF LARGE TRANSFORMERS HAVING LAMINATED CORES, PARTICULARLY CORES OF ANNEALED AMORPHOUS METAL ALLOYS

This application is a division of Ser. No. 09/841,833 filed on Apr. 25, 2001.

FIELD OF THE INVENTION

The present invention relates to an apparatus and method for the manufacture of large transformers, and more particularly to large transformer cores made from strip, ribbon of plates composed of ferromagnetic material, particularly annealed amorphous metal alloys.

BACKGROUND OF THE INVENTION

Transformers conventionally used in distribution, industrial, power, and dry-type applications are typically of the wound or stack-core variety. Wound core transformers are generally utilized in high volume applications, such as distribution transformers, since the wound core design is conducive to automated, mass production manufacturing techniques. Equipment has been developed to wind a ferromagnetic core strip around and through the window of a pre-formed, multiple turns coil to produce a core and coil assembly. However, the most common manufacturing procedure involves winding or stacking the core independently of the pre-formed coils with which the core will ultimately be linked. The latter arrangement requires that the core be formed with one or more joints for wound core and multiple joints for stack core. Core laminations are separated at those joints to open the core, thereby permitting its insertion into the coil window(s). The core is then closed to remake the joint. This procedure is commonly referred to as "lacing" the core with a coil.

A typical process for manufacturing a wound core composed of amorphous metal consists of the following steps: ribbon winding, lamination cutting, lamination stacking or lamination winding, annealing, and core edge finishing. The amorphous metal core manufacturing process, including ribbon winding, lamination cutting, lamination relatively complex. Furthermore, in aligning the multiple core limbs, the procedure utilized exerts additional stress on the cores as each core limb is flexed and bent into position. This additional stress tends to increase the core loss resulting in the completed transformer.

The core lamination is brittle from the annealing process and requires extra care, time, and special equipment to open and close the core joints in the transformer assembly process. This is an intrinsic property of the annealed amorphous metal and cannot be avoided. Lamination breakage and flaking is not readily avoidable during this process opening and closing the core joint, but ideally is minimized. The presence of flakes can have broadened detriments to the operation of the transformer. Flakes interspersed between laminar layers can reduce the face-to-face contact of the laminations in a wound core, and also be the cause of electrical short circuits within the core itself, and thus reduce the overall operating efficiency of the transformer. Flakes and the site of a laced joint also reduces the face-to-face contact, reduces the overlap between mating joint sections and again reduces the overall operating efficiency of the transformer. This is particularly important in the locus of the laced joint as it is at this point that the greatest losses are expected to occur due to flaking. Containment methods are required to ensure that the broken flakes do not enter into the coils and create potential short circuit conditions. Stresses induced on the laminations during opening and closing of the core joints oftentimes causes a permanent increase of the core loss and exciting power in the completed transformer, as well as permanent reductions in operating efficiency of the transformer.

Thus, it would be particularly advantageous to the art to provide an improved process for the manufacture of transformers, particularly large transformers having laminated metal cores, especially where such cores are of amorphous metal alloys such as those used in power transformers which improved process inherently features a reduced likelihood of lamination breakage which may occur during the assembly of a power transformer.

It would also be particularly advantageous to provide an improved process for the manufacture of transformers which process comprises reduced handling and manual manipulation steps, and thereby a reduced likelihood of lamination breakage which may occur during the assembly of a power transformer.

It would also be advantageous to provide an annealed amorphous metal core featuring reduced internal stresses and which produced by an improved manufacturing process which includes reduced handling and manual manipulation.

It would also be beneficial to the art to provide a laminated amorphous metal core, particularly three-limbed amorphous metal cores, featuring reduced internal stresses and which produced by an improved manufacturing process which includes reduced handling and manual manipulation.

It is to these and other needs that the present invention is directed.

SUMMARY OF THE INVENTION

In one aspect the present invention provides an apparatus useful in the manufacture of large transformer cores, particularly, in the manufacture of large transformer cores made of a ferromagnetic material, especially of annealed amorphous metal alloys.

In a further aspect the present invention provides improved manufacturing methods useful in the manufacture of large transformer cores, particularly, in the manufacture of large transformer cores made of a ferromagnetic material. Such ferromagnetic materials include oriented and amorphous metals which are laminated to form transformer cores. Such transformer cores may be laminated either by stacking or winding a ribbon, strip or plate of a ferromagnetic material in order to constitute the transformer core. The methods taught herein are especially advantageously used in the manufacture of large power transformers having wound cores of annealed amorphous metal alloys.

In a further aspect of the invention there is provided a transformer produced according to a manufacturing processes described herein, especially where such transformer includes a transformer core having a duty rating of from about 5 kVA to about 50 MVA.

These aspects as well as still further aspects of the invention will become more apparent from the following description.

DETAILED DESCRIPTION AND PREFERRED EMBODIMENTS

Figure 1:
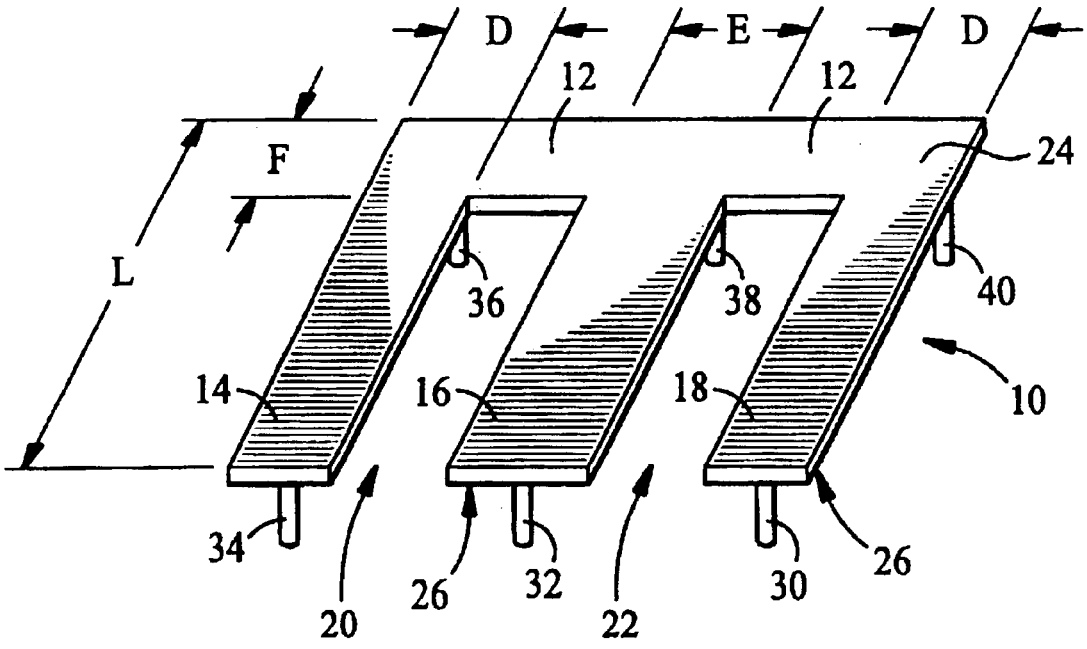
FIG. 1 depicts a stage according to a preferred embodiment of the invention useful in the manufacture of large transformer cores.

FIG. 1 depicts a stage 10 according to one preferred embodiment of the invention. As can be seen from the figure, stage 10 includes an end portion 12 having depending therefrom a plurality, here three support legs 14, 16, 18. Between adjacent support legs there exists a gap 20, 22. As also can be seen from the figure, the support legs 14, 16, 18 depend from an end portion 12 of the stage 10 and are essentially coplanar therewith. Conveniently the stage 10 is formed from a unitary sheet of an appropriate material. As can be further seen in the drawing, opposite from the top surface 24 and depending downwardly from the bottom surface 26 of the stage 10 is at least one, but preferably six, support legs 30, 32, 34, 36, 38, 40. Each of these support legs are conveniently of equal length such that when the stage 10 and support legs 30, 32, 34, 36, 38, 40 are assembled as depicted in FIG. 1, upon a horizontal support surface such as a floor (not shown), the top surface 24 of the stage 10 is essentially parallel with said floor. Further, it is preferred that at least the three forward legs 30, 32, 34 are movable from the positions depicted in FIG. 1, and can be either removed, or placed at different locations between the support surface and the underside 26 of the stage 10.

With regard to the relative dimensions of the stage 10, it is to be understood that the depicted embodiment of FIG. 1 is but one of a number of preferred embodiments. The embodiment depicted in FIG. 1 is ideally suited to be used in the production of a three-limbed transformer, such as a three-limbed transformer having two cores of approximately equal sizes wherein each of the said cores is produced from stacked laminar layers of an appropriate material. Once such appropriate material is silicon steel. A further appropriate material and preferred material is an amorphous metal. Other magnetizable materials which are not specifically recited here, but which can enjoy the benefits of the invention can also be utilized. With regard to the materials of the construction at stage 10, ideally the stage 10 is produced from a single sheet of a sufficiently rigid material such as a metal or, a synthetic material such as a reinforced nonmetallic sheet such as a polymer. Such a polymer sheet may include a reinforcing web matrix or fibers or strands to improve the stiffness of the polymer. One preferred synthetic material are epoxy impregnated laminar sheets. Other materials, although not expressly recited here, can also be utilized, it only being necessary that the material have sufficient strength and rigidity able to support the transformer cores to which a particular configuration of the stage 10 is adapted to be used.

Returning to the dimensions and arrangement of the stage 10, according to the embodiment of FIG. 1, the stage 10 is ideally dimensioned in order to be used on the construction of a three-limbed transformer. Turning now to the specific sections of the stage, it is contemplated that the width (as represented by "D") of the two support legs 14, 18 be equal to each other in size, and uncertain preferred embodiments the width be not greater than the width of the portion of the wound transformer core which is intended to be placed upon these portions of the stage 10. With regard to the center support 16, its width (as represented by "E") is preferably equal to or less than the combined widths of the two adjacently placed legs of the transformer cores which are intended to be placed upon the stage 10. This arrangement will be more clearly described with reference to further figures. It is nonetheless expected that the widths "D" and "E" may be greater than the widths of the wound transformer cores. With regard to the top portion 12 of the stage 10, its width (as represented by "F") is not critical, but needs to be only sufficiently wide in order to provide adequate mechanical support to those portions of the two wound cores which are ultimately placed upon the stage. Again, it is not necessary that the width of the top portion 12 be less than or equal to the widths of the corresponding portions of the cores, which indeed can be wider, or narrower.

Figure 2:
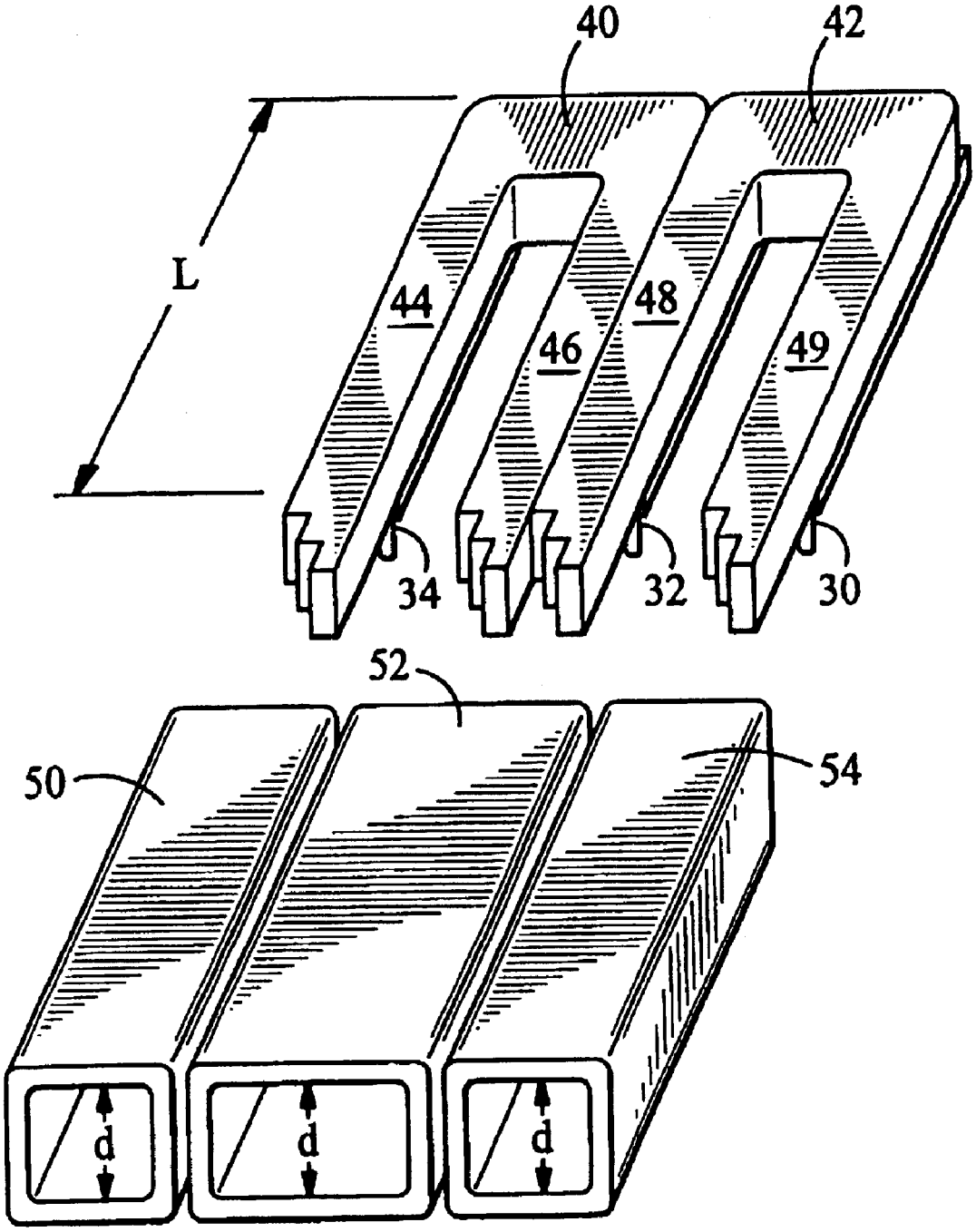
FIG. 2 illustrates in perspective view two unlaced wound transformer cores and three suitably dimensioned transformer coils in a position prior to their insertion on the unlaced ends of the appropriate transformer cores.

Turning now to FIG. 2, there is depicted in a perspective view, a representation of the stage 10 of FIG. 1, further depicting two unlaced wound transformer cores 40, 42 appropriately placed upon the top surface of the stage 10. Further visible on FIG. 2 is a representation of three suitably dimensioned transformer coils 50, 52, 54 in a position prior to their insertion on the unlaced ends of the appropriate transformer cores 40, 42. As can be seen from FIG. 2, the relative widths of the support parts 14, 16, 18 of FIG. 1 are not greater than the widths of the corresponding core legs 44, 46, 48, 49. Additionally, as can be seen from FIG. 2, the overall length (as represented by "L") of the stage 10 and support legs 14, 16, 18 is less than the length of the transformer core legs 44, 46, 48, 49 when in an unlaced position. Additionally, it is to be understood that it is preferred that the length "L" of the stage should not unduly hinder the relacing and the reassembly of the transformer core 40, 42, nor the installation of the transformer coils 50, 52, 54 thereupon. As further will be appreciated from a review of FIG. 2, each of the transformer coils 50, 52, 54 are those of a cylindrical configuration, and each has an internal dimension "d" which is suitably sized for placement upon the appropriate core legs 44 and 49 and the abutting legs 46, 48. It is, however, to be understood that transformer coils of different configurations, i.e., including known art as circular or square cross-sectioned transformer coils which can also be utilized in accordance with the present inventive teaching.

Figure 3:
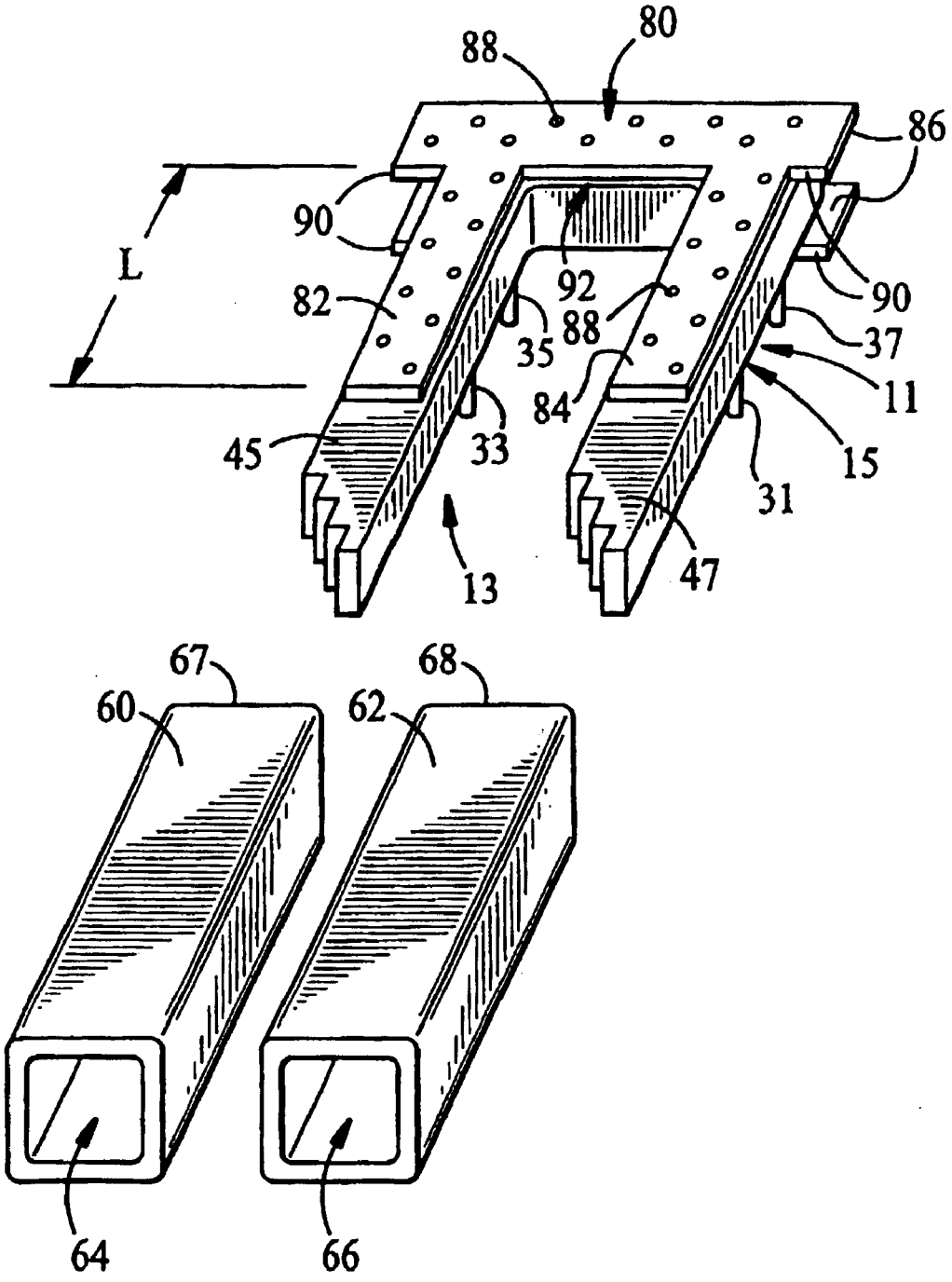
FIG. 3 depicts an alternative preferred embodiment of the invention useful in the manufacture of large transformer cores.

Turning now to FIG. 3, there is depicted an alternative embodiment of a stage 11 according to the present invention. As can be seen from the figure, this embodiment includes only two support legs 13, 15 (although not visible) extending from and dependent from an end portion 17. Support stage 11 is placed upon four supporting legs 31, 33, 35, 37. As has been described with reference to FIG. 1, these legs depend from the under surface of the stage 11 and at least the two forward legs, here legs 31, 33 are movable. It is contemplated that all the legs 31, 33, 35, 37 may be moved from their positions depicted in FIG. 3.

Also visible is a transformer core, here a single transformer core having two legs 45, 47, in an unlaced condition laid upon the top surface of the stage 11. The transformer core is interposed between two supports 80, 86, each having two dependent legs (i.e., 82, 84 of support 80) and in this particular embodiment a plurality of perforations 88 passing therethrough. Additionally, each support plate 80 also includes extended end portions 86. For sake of brevity, the supports 80 are suitably dimensioned plates which are adapted to be adhered or affixed to portions of one or more legs of a transformer core as well as at least a top portion of a transformer core. The supports 80 can be adhered, affixed, or fastened by any appropriate means to the transformer core. Where a transformer core is produced of a series of laminations, i.e., such as a wound transformer core, desirably the support 80 is adhered to the edges or margins of these laminations. As is seen in FIG. 3, two supports 80 are affixed to opposite faces of the transformer core. Also, the dependent legs 82, 84 of the support 80 are desirably not wider than the thickness of the transformer core legs 45, 47.

Further depicted in FIG. 3 are two transformer coils 60, 62 which are adapted and dimensioned to be installed upon the transformer core legs 45, 47 and portions of the support 80, particularly legs 82, 84. As depicted, the transformer coils 60, 62 are hollow, and include passages 64, 66 of a generally rectangular cross section whose dimensions are adapted to allow the installation upon the transformer core legs and support as described. Further, it will be appreciated that upon installation, downwardly facing margins 90 of the extended ends 86, as well as portions of the downwardly extending margin 92 of the support 80 may provide a physical support surface which contacts a top portion 67, 68 of the transformer coils 60, 62, or which may contact another structural support.

The stage provided in accordance with the present invention provides a particularly useful assembly tool for the fabrication of transformers. In particular, the apparatus described herein is especially useful for the fabrication of large transformers, particularly those transformers which include laminated transformer cores which need be unlaced in order to allow the insertion of transformer coils, and then subsequently relaced prior to the use in transformers. The inventive apparatus and assembly processes taught herein are especially useful in the manufacture of large transformers having amorphous metal cores. As is known in the art, annealed amorphous metals are known to be particularly difficult to handle due to their brittleness which results from an annealing operation. It is highly desired that the handling of such wound amorphous metal cores formed of laminations of amorphous metal strips be minimized in order to reduce the likelihood of breakage or flaking of the amorphous metal strips. This breakage or flaking is known to introduce core losses, as well as the possibility of causing electrical shorts within the transformer core itself. The apparatus, and processes taught according to the present invention, address these and other technical concerns.

Turning now to FIG. 4, there is depicted a series of individual figures which are representative of various stages of a first and preferred embodiment of the assembly process according to the invention. Turning first to FIG. 4A, there is depicted in a side view a transformer core 100 in an unlaced condition, a first support 102 layered in register on a top surface 104 of the core 100, and a second support 106 layered in register with a bottom surface 108 of said core 100. The core 100 and supports 102, 104 are horizontally laid upon a stage 110 which stands upon legs 112, 114. Also depicted is a transformer coil 120 having an internal passage 124 passing therethrough (indicated by dotted lines) which internal passage is suitably dimensioned to admit for the ultimate insertion of the coil 100 and supports 102, 106 therein. Also depicted are a series of coil supports 126 suitably dimensioned such that the height of the internal passage 124 is such that assembly of the coils 120 upon the transformer core 110 and supports 102, 106 is facilitated as is described in more detail hereinafter. Conveniently, the coil supports 126 can be a platform including a moveable platform or a series of movable rollers which facilitate the movement and positioning of the transformer coil 102 upon a supporting surface, i.e., a floor (not shown). However, it is also understood that coil supports 126 can be omitted and alternative supporting means, i.e., such as a winch and chain, or other suitable support capable of bearing the mass of the transformer coil 120 yet permit the relative movement of the transformer coil 120 with the transformer core 100 and supports 102, 106 can be used in their place.

Figure 4A:
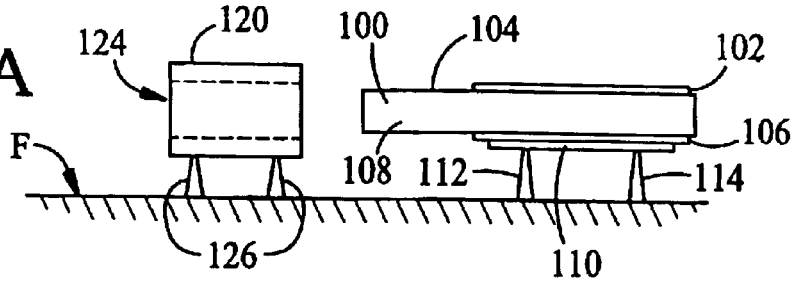
FIG. 4 shows a series of individual figures representative of various stages of a first embodiment of the manufacturing process according to the invention.
Figure 4B:
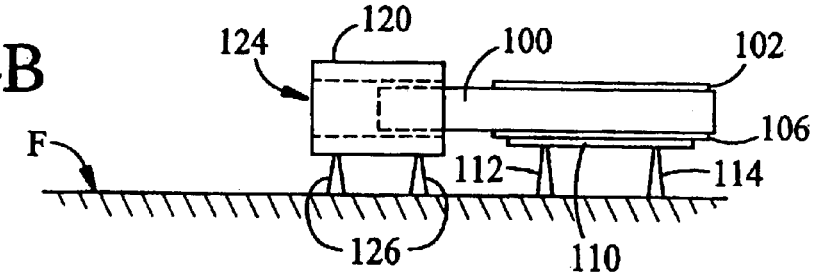

Turning now to FIG. 4B, there is depicted a next step of the process wherein the transformer coil 120 and the transformer core 100 are moved relative to one another so that at least a portion of the transformer core 100 is inserted within the transformer coil 120. This can be easily accomplished via the coil supports 126, particularly when such are rollers or the like.

Figure 4C:
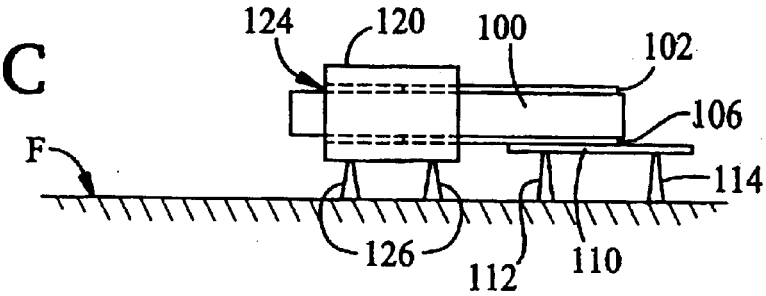

In a next stage of this process, as depicted in FIG. 4C the stage 110 and the transformer coil 120 abut, thus facilitating the transfer of the transformer coil 100 into the interior of the transformer coil 120. According to FIG. 4C, this is shown with a portion of the transformer core 100 still extending outward from the interior of the transformer core 120 and resting upon the top surface of the stage 110. As also will be realized from a review of FIG. 4C, in order to facilitate this transfer, it is desirable that the overall height of the support legs 112, 114, the thickness of the stage 110 be at least as high as the total height of the transformer coil supports 126 and the thickness of the transformer coil so that such a transfer can be easily practiced. Ideally, wherein the transformer core 110 is provided with at least one transformer support 102, 104, the surface of the support 104 acts as a slidable surface and protects the wound transformer core, particularly when such is formed of an annealed and wound amorphous metal strips which are particularly frangible.

Figure 4D:
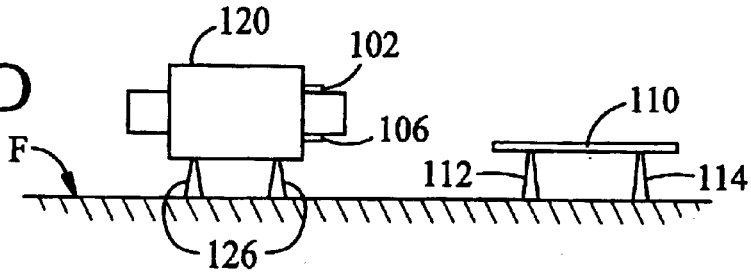

Turning now to FIG. 4D, there is shown a next, near final step of the process. As can be seen thereon, the transformer core 100 and supports 102, 106 are sufficiently inserted within the interior of the transformer coil 120 so that it is wholly supported thereby. The stage 110 and its supporting legs 112, 114 can now be moved away, and not necessarily further used in the process. Then steps can be repeated for any remaining transformer coils which need be assembled with a portion of the transformer core.

Subsequently, the unlaced ends of the transformer core can be relaced according to conventional techniques and thereafter the assembled transformer core and coil assembly can be vertically uprighted such as by the use of a tilting table, or by a crane, winch or the like. Wherein such an embodiment of a transformer coil assembly including one or more supports is produced, and the whole assembly is uprighted, and as described with reference to FIG. 3, portions of the supports 102, 106 can provide a physical suspended support to the wound transformer core and facilitate in reducing further physical stresses when the assembly is in a final, vertical upright position.

FIG. 5 depicts a further alternative and preferred process according to the invention. FIG. 5A depicts a laminated wound transformer core 100, in an unlaced condition interposed between two supports 102, 106. Additionally shown is a transformer coil 170 which has an internal passage therein 172 which is appropriately dimensioned for the insertion of the transformer core 100 within. As further can be seen from FIG. 5A, the transformer core 100 and support 102 rests directly upon a stage 110 having at least two support legs 112, 114, at least one of which, (leg 112) is displaceable from its indicated position.

Figure 5A:
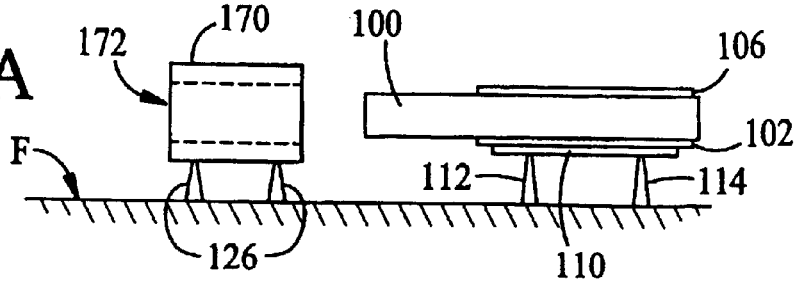
FIG. 5 illustrates a series of individual figures representative of various stages of a second embodiment of the manufacturing process according to the invention.
Figure 5B:
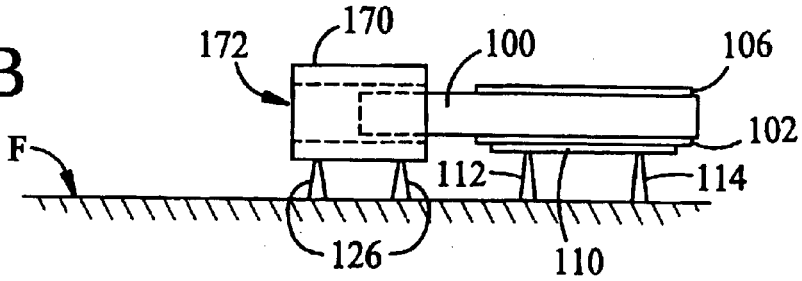

FIG. 5B indicates the next step in the assembly process according to FIG. 5. Therein, at least a portion of the transformer core 100 and supports 102, 106 is inserted into the interior passage 172 of the transformer coil 170. The transformer coil 170 is supported by supports but it is nevertheless to be appreciated that any suitable support means such as a suspensive support or load bearing support can be utilized.

Figure 5C:
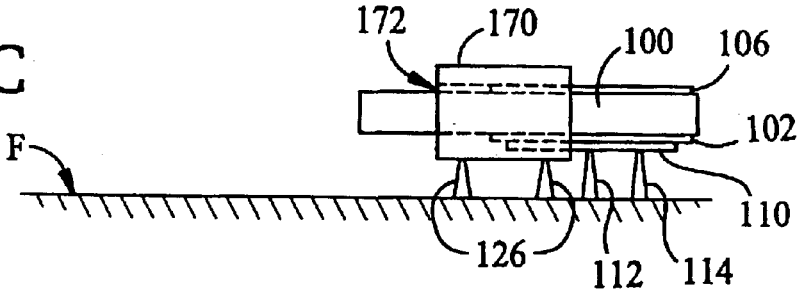

With respect now to FIG. 5C, a next step of the process is depicted therein. As can be seen from FIG. 5C, the forward leg 112 has been displaced from its initial position, and is placed more proximate to the rearward leg 114. A portion of the stage 110 supporting the transformer coil 100 and supports 102, 106 is inserted into the interior of the transformer coil 170. It is to be understood that in an alternative to the arrangement shown in FIG. 5C, one or more of the legs, particularly leg 112 can be omitted and need not be present wherein the transformer coil 170 is sufficiently and suitably supported such that the mass of the transformer core 100, at least that portion of the stage 110 and the transformer coil itself 170 is supported and thereby permitting for the omission of leg 112.

Figure 5D:
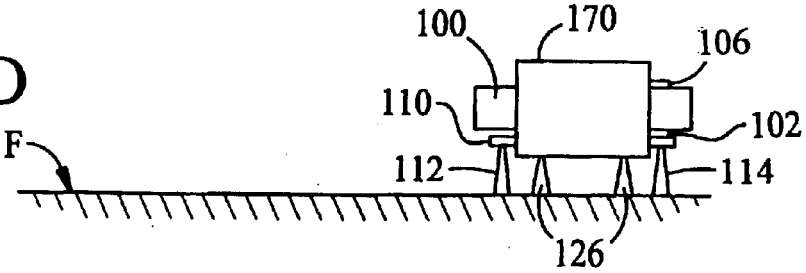

FIG. 5D shows a next step in the process wherein a further arrangement of the transformer core 100 and the transformer coil 170 is depicted. As can be seen, the stage 110 further supports the transformer coil 100 and the support legs 112, 114 are placed at opposite sides of the transformer coil 170 so to facilitate the load bearing of the support 110 upon which the transformer coil 100 and the transformer coil 170 both rest. As will be appreciated, particularly with regard to FIG. 5D, such an arrangement of the stage 110 and its supporting legs 112, 114 greatly facilitates the convenient placement of the unlaced end of the transformer coil 150 such that it can be manually relaced and reconstituted: Subsequently, the stage 110 can be withdrawn from the interior of the transformer coil 170 and removed from the completed transformer core and coil assembly. This can be done by any appropriate means, but most desirably, this removal is effectuated when the assembled transformer core and coil assembly is vertically uprighted so that the mass of the transformer coil 100 no longer rests upon the stage 110. In such a vertical position, the stage can be more readily withdrawn than in a position shown in FIG. 5D.

FIG. 6 depicts a yet further preferred embodiment of an assembly process according to the present invention. This assembly, the process described herein can be distinguished from the processes described in the earlier FIGS. 4 and 5 in that no stage supporting the transformer core 100 is used. Rather one of the supports, here support 106 is used instead. Such provides further advantages to the assembly process.

Figure 6A:
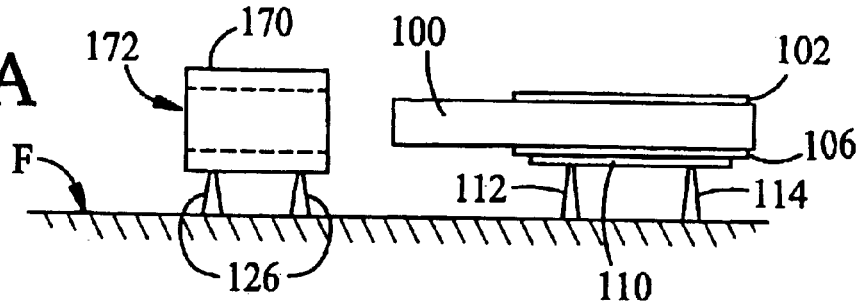
FIG. 6 illustrates a series of individual figures representative of various stages of a third embodiment of a manufacturing process according to the invention.

FIG. 6A depicts a transformer core 100 in an unlaced condition interposed between two supports 102, 106. Supporting legs 112, 114 support the core 100 in a horizontal position approximately parallel to the floor F, and is at a convenient height with respect to a transformer coil 170.

Figure 6B:
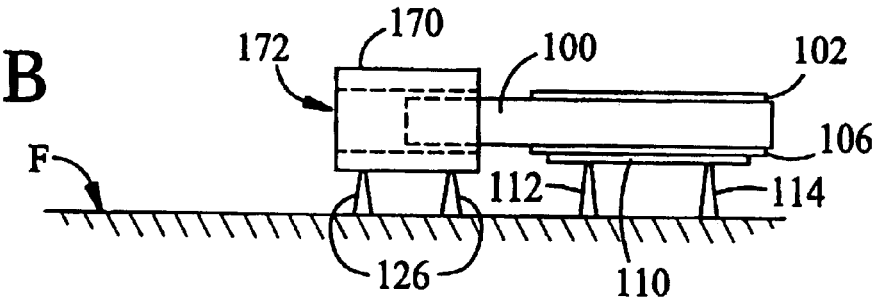

FIG. 6B indicates the next step in the assembly process according to FIG. 6. Therein, transformer coil 170 and the transformer core 100 are moved together so that at least a portion of the transformer core 100 is inserted within the internal passage 172. Transformer supports 126 are ideally moveable supports (or alternately can be a crane, winch or insufficiently load bearing structure which permits such movement) is facilitated.

Figure 6C:
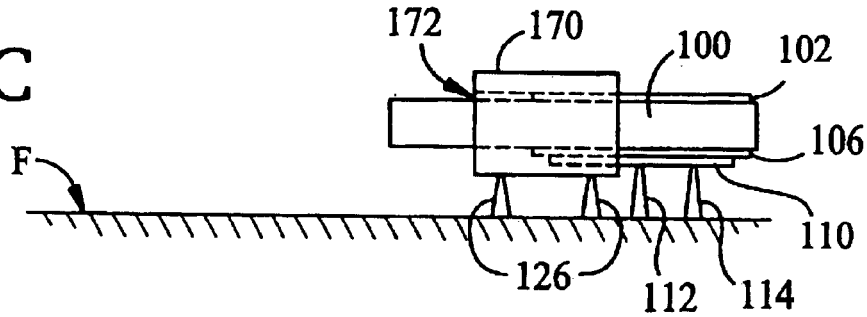

Turning now to FIG. 6C, a next step of the process is depicted. In this figure, the transformer core 100, and at least portions of supports 102, 106 are now all inserted into the internal passage 172 of the transformer coil 170. As can be seen from the figure, the support 106 rests upon the inner surface of the internal passage 172 and is in sliding relationship therewith. Also, as depicted in FIG. 6C according to preferred embodiments, the dimensions of the internal passage 172 are controlled such that a close tolerance fit is achieved between the transformer core 100 and its supports 102, 106 and the transformer coil 170.

Figure 6D:
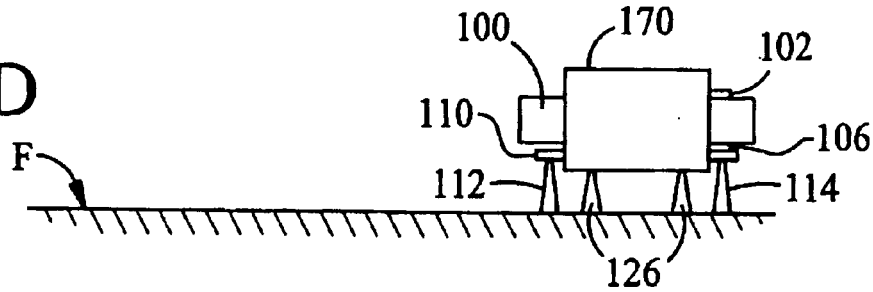

FIG. 6D shows a next step in the process. As is shown, the transformer core 100 and support plates 102, 106 have been brought to rest within the transformer coil 170 and their final assembled relationship. The unlaced ends of the transformer core 100 extend through the internal passage 172 and are positioned ready for relacing and reconstitution of the transformer core. In the figure, bearing support legs 12 have been removed and actually, both load bearing legs 112, 114 may be omitted wherein the mass of the transformer core 100 and supports 102, 106 is now borne by the transformer coil 170 which in turn is supported by support legs 126. After the transformer core is reconstituted thereafter the assembled transformer core and coil assembly are separated by any appropriate means including the use of an operating table, crane or winch as has been discussed previously.

A significant distinction and an advantage in the process as shown in FIG. 6 lies in the omission of the stage 110. The omission of the stage 110 provides for the ability for a much closer tolerance fit of the assembled transformer core 100 and supports 102, 106 within the interior of the transformer coil, thereby minimizes not only the size of the ultimately assembled transformer, but also reduces the potential for operating losses in such an assembled transformer. Also, by the omission of a stage 110, process step, i.e., the removal of the stage subsequent to the reconstitution of the transformer core may be omitted. This not only saves time and handling operations, but also reduces the likelihood of breakage or flaking of the transformer core, particularly when such is fabricated of an annealed amorphous metal.

It is also to be understood that each of the individual steps discussed in the assembly techniques described with reference to FIGS. 4, 5 and 6 may be repeated as is necessary for any particularly transformer design. Each of these assembly techniques is greatly simplified and only discusses the insertion of a transformer coil upon a single transformer leg. Naturally, it is to be understood that where a transformer has two or more coil legs, that the individual steps within each one of these assembly processes can be repeated an appropriate number of times until the transformer is finally assembled.

Figure 7:
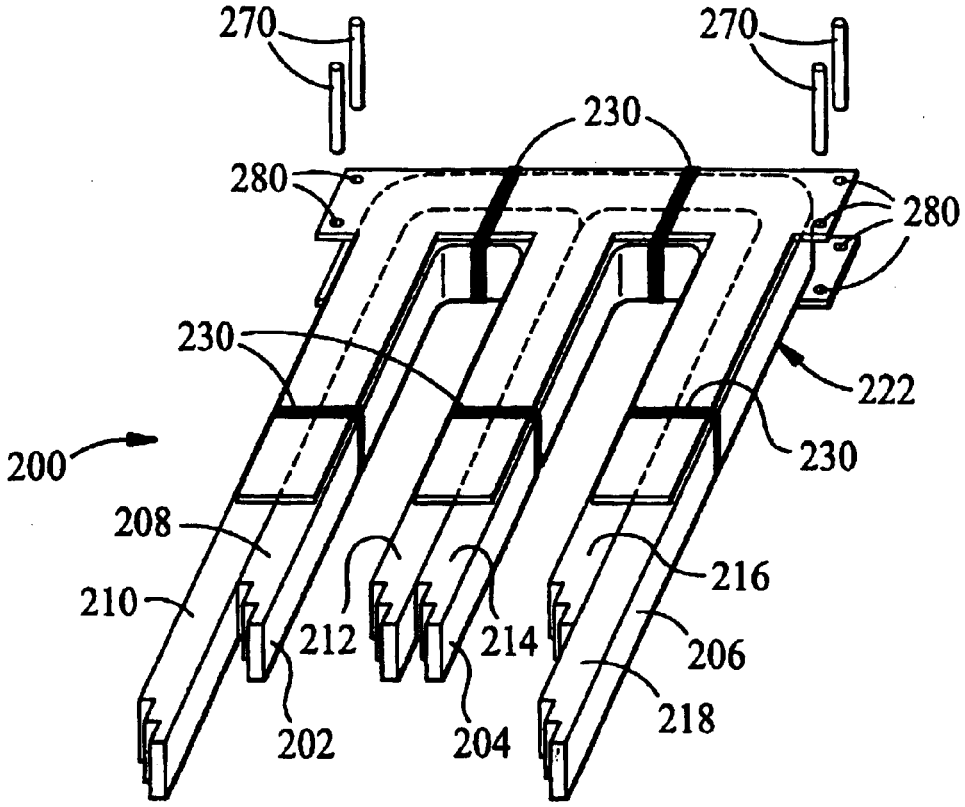
FIG. 7 illustrates in perspective view a three coil, three limbed transformer core in an unlaced condition, and three suitably dimensioned transformer coils in a position prior to their insertion on the unlaced ends of the appropriate legs of the transformer.
Figure 7:
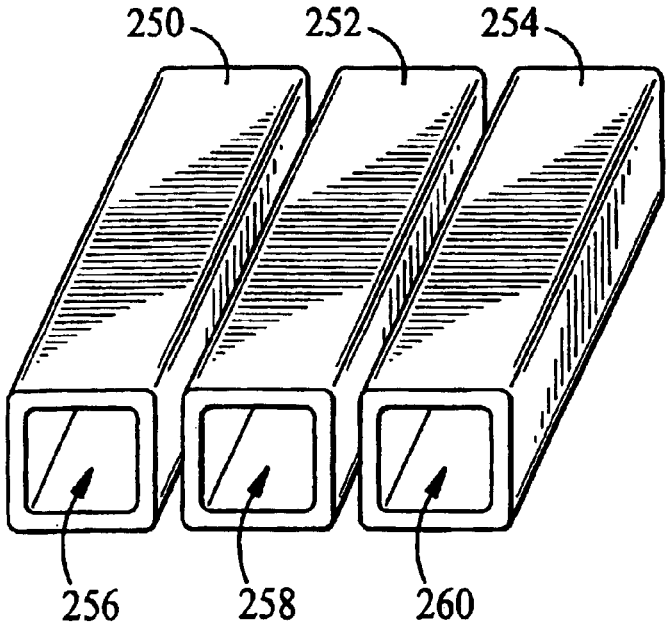

Turning now to FIG. 7, there is depicted a particularly advantageous transformer configuration which benefits from the assembly processes described herein. Illustrated thereon is a three-limbed-three-core transformer 200. The transformer is comprised of a first inner core 202, a second inner core 204, both of which are encased within a third, outer core 206. The two inner cores 202, 204 each have one leg abutting each other and each has its remaining leg abutting one of the legs of the outer transformer core 206. Namely, the first inner core 202 has its outer leg 208 abutting a first leg 210 of the outer core 206 and its inner leg 212 abuts the inner leg 214 of the second inner core 204. The outer leg 216 of the second inner core 204 abuts the other leg 218 of the outer core 206. As is also depicted in FIG. 7, only one end of each of the three cores is in an unlaced condition, while the opposite ends either form from similar already assembled joints or indeed include no joints within each respective core. Further shown are two supports 220, 222 having interposed therebetween the three cores 202, 204, 206. The relationship and configuration of the cores 202, 204, 206 with respect to the supports 220, 222 are clearly depicted on FIG. 7. The supports 220, 222 illustrate an alternative embodiment of supports which may be used in conjunction with transformer cores which do not include perforations passing therethrough. Instead, it is contemplated that these can be omitted entirely. Such is possible wherein a suitable adhesive material might be interposed between facing portions of the respective transformer core (s) and supports. It is also contemplated that such an adhesive or material might be used either in conjunction with or independently of one or more binding straps 230 which encircle portions of both supports and at least a portion of the transformer core(s). Such straps, when present can be placed wherever thought suitable, and can be made from any appropriate material, either ferrous or non-ferrous. It is also contemplated that in certain assembly techniques, such straps 230 might only be used during the assembly process, then might be removed prior to the final assembly stages of the power transformer which includes transformer cores made according to the present inventive processes.

Further depicted on FIG. 7 are a plurality of transformer coils 250, 252, 254, each respectively having passages therethrough 256, 258, 260 suitably dimensioned to allow for the insertion of each one of the respective legs of the three-limbed, three-phase transformer core. A further feature depicted under FIG. 7, but which might equally apply to the configurations and the processes described in any one of FIGS. 1-6 are assembly rods 270 which are suitably dimensioned so to extend through corresponding holes 280 in one or more of the supports 220, 222. Preferably, the rods 270 are threaded so that when each rod is passed through a pair of corresponding holes, one in each of the respective supporting spaces 220, 222 fastening means, such as nuts can be threaded onto extending ends of the rods 270 allowing for the rods 270 to be tensioned, and likewise the support plates 220, 222 compressed. Alternately, of course, the holes 280 themselves may be suitably threaded and dimensioned to accept the support rods 270 which, in turn, may also be threaded. One advantageous example would be the use of rods which have a standard thread at one end and a reverse thread at the opposite end; rotation of the rod in one direction would ensure tensioning of the rod wherein corresponding immediate threads are also cut into the holes 280.

With regard to the actual assembly of the three-limbed three-phased transformer core as depicted in FIG. 7, such can be according to any one of the processes described previously, particularly those discussed with reference to FIGS. 4, 5, but most preferably according to FIG. 6. The advantage to the process according to FIG. 6 has been described previously and is particularly useful wherein the transformer core is made of an annealed amorphous metal laminate.

A particular advantage of the processes described herein, particularly in conjunction with the assembly of a three-limbed, three-phase transformer core formed from three annealed amorphous metal cores lies in the fact that handling of the embrittled annealed metal is minimized. This is of grave concern to fabricators of power transformers as the annealed amorphous metal transformer cores once removed from an annealing oven wherein magnetic stresses are reduced by the heating process are extremely brittle According to the configuration and the process discussed with reference to FIG. 7, the actual number of joints which are necessary to be laced or unlaced is minimized. According to a particular preferred embodiment, each one of the three transformer cores need only include one laceable joint therein. Actually, the benefits of the invention would also apply to configurations where transformer joints may have two or more laced joints within each core although in many cases, such are desirably avoided. Use of support plates which are held in close physical contact with opposite faces of it of an annealed amorphous metal transformer core acts to stabilize this frangible material and to greatly facilitate in its handling. This is particularly significant, wherein the transformer cores are physically very large, such as are expected wherein power transformer cores operate within the duty rating of 5 kVA to about 50 MVA. A further complication arising from the manufacture of such very large transformers also lies in the fact that indeed the number of laminations within each transformer core is usually very large. Naturally, the greater number of laminations requires a greater number of individual handling steps in relacing step for each one of the cores. This is yet a manual operation, this is prone to accidents and very undesired breakage of individual laminations or lamination packets. Again, breakage in the transformer laminations attended upon any of the handling or fabrication steps of a power transformer acts to reduce the operating efficiency of a power transformer and therefore are to be avoided at almost all costs. Practice of the present invention minimizes such handling steps and consequently provides significant advantage to the power transformer core assembly art which is heretofore not been known. The advantages include not only reduced likelihood of transformer breakage, but also an increased rapidity in the assembly of such power transformers due to the minimization of the handling steps as well as the improved handling of the annealed transformer cores made possible with a positive inventive effort. Returning now to the depictions of the transformer cores, supports, processes described herein, it is to be understood that certain features are transposable. For example, each of the supports need not always have extending ends such as shown as 90 in FIG. 3, such ends may be omitted. Perforations such as perforations 88 passing through the support 80 as depicted on FIG. 3 are not essential, but frequently are useful especially wherein an adhesive such as a hardenable adhesive, i.e., an epoxy resin is used between the transformer core and a support. Such an adhesive, when compressed in its moldable state typically extends at least partially into these perforations 88 and hardens. This is advantageous in providing a "post" which is load bearing, particularly when the transformer cores are large. Further, the use of straps 230 such as depicted on FIG. 7 may be used according to any one of the embodiments described in FIGS. 1-7. Again, these straps may be only of a temporary nature although, of course, they can be permanently affixed and retained in the finally assembled power transformer. Likewise support rods 270 can also be used in the various embodiments depicted on FIGS. 1-6. The support rods indeed not be solid, or generally cylindrical in configuration, but may be substituted by any other physical support structure. By way of non-limiting examples, such as support structure, could include a member intermediate any two spaced-apart supports, such as a plate, block, and the like. Further, threading is not the sole means whereby an intermediate support be affixed between two support plates, but any other affixing means can also be used such as welding, soldering, stamping, compression, as well as the use of adhesives and other binding materials can also be used.

While the manufacturing processes described herein which are advantageously practiced in the assembly of wound metal cores of virtually any metal, including crystalline metals such as silicon steels presently widely used in industry, the manufacturing processes are most beneficial in the manufacture of wound amorphous metal cores formed of an amorphous metal alloy. As to useful amorphous metals, generally stated, the amorphous metals suitable for use in the manufacture of wound, amorphous metal transformer cores can be any amorphous metal alloy which is at least 90% glassy, preferably at least 95% glassy, but most preferably is at least 98% glassy.

Preferred alloys for use in the manufacture of the amorphous metal transformer cores of the present invention are defined by the formula:

$$M_{70\text{-}85}Y_{5\text{-}20}Z_{0\text{-}20}$$

wherein the subscripts are in atom percent, "M" is at least one of Fe, Ni and Co. "Y" is at least one of B, C and P, and "Z" is at least one of Si, Al and Ge; with the proviso that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb. Such amorphous metal transformer cores are suitable for use in voltage conversion and energy storage applications for distribution frequencies of about 50 and 60 Hz as well as frequencies ranging up to the gigahertz range.

By way of non-limiting example, devices for which the transformer cores of the present invention are especially suited include voltage, current and pulse transformers; inductors for linear power supplies; switch mode power supplies; linear accelerators; power factor correction devices; automotive ignition coils; lamp ballasts; filters for EMI and RFI applications; magnetic amplifiers for switch mode power supplies; magnetic pulse compression devices, and the like. The transformer cores of the present invention may be used in devices having power ranges starting from about 5 kVA to about 50 MVA, preferably 200 kVA to 10 MVA. According to certain preferred embodiments, the transformer cores find use in large size transformers, such as power transformers, liquid-filled transformers, dry-type transformers, and the like, having operating ranges most preferably in the range of 200 KVA to 10 MVA. According to certain further preferred embodiments, the transformer cores according to the invention are wound amorphous metal transformer cores which have masses of at least 200 kg, preferably have masses of at least 300 kg, still more preferably have masses of at least 1000 kg, yet more preferably have masses of at least 2000 kg, and most preferably have masses in the range of about 2000 kg to about 25000 kg.

The application of the invention where the transformer cores are produced of amorphous metal alloys derive a great benefit benefit from the present invention. As such amorphous metal alloys are typically only available in thin strips, ribbons or sheets ("plates") having a thickeness generally not in excess of twenty five thousandths of an inch. These thin dimensions necessitate a greater number of individual laminar layers in an amorphous metal core and substantially complicates the assembly process, particularly when compared to transformer cores fabricated from silicon steel, which is typically approximately ten times thicker in similar application. Additionally, as will be appreciated to skilled practitioners in the art, subsequent to annealing, amorphous metals become substantially more brittle than in their unannealed state and mimic their glassy nature when stressed of flexed by easily fracturing. Due to the lack of long range crystalline order in annealed amorphous metals, the direction of breakage is also highly unpredictable and unlike more crystalline metals which can be expected to break along a fatigue line or point, an annealed amorphous metal frequently breaks into a multiplicity of parts, including troublesome flakes which are very deleterious as discussed herein.

Certain of the mechanical assembly steps required to manufacture the transformer cores according to the present invention include conventional techniques which may be known to the art, or may be described in either U.S. Ser. No. 08/918,194 or U.S. Ser. No. 09/311,423 the contents of which are herein incorporated by reference. Generally, in order to manufacture a transformer core from a continuous ribbon or strip of an amorphous metal, prior to any annealing step the cutting and stacking of laminated group and packets is carried out with a cut-to-length machine and stacking equipment capable of positioning and arranging the groups in the step-lap joint fashion. The cutting length increment is determined by the thickness of lamination grouping, the number of groups in each packet, and the required step lap spacing. Thereafter the cores, or core segments may be shaped according to known techniques, such as bending the laminated groups or packets about a form such as a suitably dimensioned mandrel. Alternately the cores may also be produced utilizing a semi-automatic belt-nesting machine which feeds and wraps individual groups and packets onto a rotating arbor or manual pressing and forming of the core lamination from an annulus shape into the rectangular core shape.

The assembled transformer cores of the invention are annealed at temperatures of between 330°–380° C., but preferably at a temperature about 350° C. while being subjected to one or more opposing magnetic fields. As is well known to those skilled in the art, the annealing step operates to relieve stress in the amorphous metal material, including stresses imparted during the casting, winding, cutting, lamination, arranging, forming and shaping steps While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

What is claimed is:

1. A process for the manufacture of a transformer comprising at least a laminated transformer core having at least one transformer leg and at least one laceable joint, said transformer further comprising at least one transformer coil which process comprises the steps of:

affixing a support to portions of at least the one transformer leg;

laying the support and the transformer core onto a stage in a generally horizontal orientation;

inserting the at least one transformer coil onto the at least one transformer leg;

reconstituting the transformer core; and withdrawing the stage from the interior of the at least one transformer coil.

2. The process according to claim 1 which includes the further process step of:

inserting a second transformer coil onto a second transformer leg prior to reconstituting the transformer core.

3. The process according to claim 1 wherein the laminated transformer core comprises an amorphous metal alloy.

4. The process according to claim 1 wherein the laminated transformer core comprises an annealed amorphous metal alloy.

5. A process for the manufacture of a transformer comprising at least a laminated transformer core having at least one transformer leg and at least one laceable joint, said transformer further comprising at least one transformer coil which process comprises the steps of:

affixing a support to portions of at least the one transformer leg;

orienting the support and the transformer core in a generally horizontal orientation;

inserting the at least one transformer coil onto the at least one transformer leg; and reconstituting the transformer core.

6. The process according to claim 5 which includes the further process step of:

inserting a second transformer coil onto a second transformer leg prior to reconstituting the transformer core.

7. The method according to claim 5 wherein the laminated transformer core comprises an amorphous metal alloy.

8. The method according to claim 5 wherein the laminated transformer core comprises an annealed amorphous metal alloy.

* * * * *